US009121406B2

(12) United States Patent
Watanabe et al.

(10) Patent No.: US 9,121,406 B2
(45) Date of Patent: Sep. 1, 2015

(54) SCROLL COMPRESSOR AND METHOD FOR MACHINING DISCHARGE PORT OF THE SAME

(75) Inventors: Takayuki Watanabe, Tokyo (JP); Takeshi Hirano, Tokyo (JP); Norio Hioki, Tokyo (JP); Shinichi Takahashi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 321 days.

(21) Appl. No.: 13/515,701

(22) PCT Filed: May 24, 2011

(86) PCT No.: PCT/JP2011/061830
§ 371 (c)(1),
(2), (4) Date: Jun. 13, 2012

(87) PCT Pub. No.: WO2011/152243
PCT Pub. Date: Dec. 8, 2011

(65) Prior Publication Data

US 2012/0251369 A1 Oct. 4, 2012

(30) Foreign Application Priority Data

Jun. 4, 2010 (JP) ..... 2010-128578

(51) Int. Cl.
*F01C 1/02* (2006.01)
*F01C 1/063* (2006.01)
(Continued)

(52) U.S. Cl.
CPC ..... *F04C 18/0215* (2013.01); *F04C 29/0035* (2013.01); *F04C 29/12* (2013.01); *F04C 18/0246* (2013.01); *F04C 2230/10* (2013.01);
(Continued)

(58) Field of Classification Search
USPC ..... 418/55.1–55.6
See application file for complete search history.

(56) References Cited

U.S. PATENT DOCUMENTS 5,242,283 A * 9/1993 Mori et al. ..... 418/55.2
5,427,513 A 6/1995 Yamada et al.
2006/0110225 A1 * 5/2006 Dov et al. ..... 407/53

FOREIGN PATENT DOCUMENTS

JP 63-215892 A 9/1988
JP 63-255585 A 10/1988
(Continued)

OTHER PUBLICATIONS

Japanese Decision to Grant a Patent dated Dec. 17, 2013, issued in corresponding Japanese Patent Application No. 2010-128578 (3 pages). Explanation of Relevancy—"The Decision to Grant a Patent has been received".
(Continued)

*Primary Examiner* — Mary A Davis
*Assistant Examiner* — Dapinder Singh
(74) *Attorney, Agent, or Firm* — Westerman, Hattori, Daniels & Adrian, LLP

(57) ABSTRACT

A scroll compressor in which a paired fixed scroll and rotating scroll each having a spiral wrap provided upright on an end plate are engaged to form a compression chamber and in which a discharge port that discharges fluid compressed in the compression chamber is provided at the central portion of the fixed scroll, wherein the discharge port has a deformed elongated hole shape having circular holes at both ends, and the circular holes at both ends are connected by two surfaces the width between which is smaller than the hole diameters of the circular holes.

8 Claims, 4 Drawing Sheets

(51) Int. Cl.

| | |
|---|---|
| ***F04C 18/00*** | (2006.01) |
| ***F04C 18/02*** | (2006.01) |
| ***F04C 2/00*** | (2006.01) |
| ***F04C 29/12*** | (2006.01) |
| ***F04C 29/00*** | (2006.01) |

(52) U.S. Cl.
CPC .. *F04C2250/102* (2013.01); *Y10T 409/304424* (2015.01)

(56) References Cited

FOREIGN PATENT DOCUMENTS

| | | | |
|---|---|---|---|
| JP | 64-063686 | A | 3/1989 |
| JP | 11-013659 | A | 1/1999 |
| JP | 2002-242863 | A | 8/2002 |
| JP | 2003-124645 | A | 4/2003 |
| JP | 3629836 | B2 | 12/2004 |
| JP | 2009-090841 | A | 4/2009 |

OTHER PUBLICATIONS

International Search Report of PCT/JP2011/061830, mailing date of Jun. 21, 2011.
Written Opinion of PCT/JP2011/061830, mailing date of Jun. 21, 2011.
Office Action dated May 6, 2014, issued in corresponding Chinese Patent Application No. 201180007581.6, with English Translation (13 pages).
Extended European Search Report dated Dec. 12, 2014, issued in European Application No. 11789652.2. (11 pages).
Office Action dated Dec. 18, 2014, issued in Chinese Application No. 201180007581.6, w/English translation. (10 pages).

* cited by examiner

SCROLL COMPRESSOR AND METHOD FOR MACHINING DISCHARGE PORT OF THE SAME

TECHNICAL FIELD

The present invention relates to a scroll compressor in which a discharge port that discharges compressed fluid from a compression chamber is provided at the central portion of a fixed scroll and to a method for machining the discharge port.

BACKGROUND ART

A scroll compressor is equipped with a paired fixed scroll and rotating scroll each having a spiral wrap provided upright on an end plate and is configured to compress fluid by causing a compression chamber, formed by engaging the scrolls, to move from its peripheral position toward the center while reducing in volume with the orbital rotary motion of the rotating scroll and to discharge the compressed fluid outwards through a discharge port provided at the central portion of the fixed scroll.

Such a scroll compressor is configured such that the compression chamber is reduced in volume while being sequentially moved to the center as the rotating scroll is rotationally driven and has a design volume ratio (compression ratio) defined by the ratio of the maximum volume of the compression chamber formed at the outermost peripheral positions of the scrolls when an intake is shut off to the minimum volume of the compression chamber directly before the engagement between the fixed scroll and the rotating scroll is released. A larger design volume ratio is efficient because it decreases the loss, and moreover, it is advantageous in terms of noise.

To increase the design volume ratio, normally, the technique of increasing the number of windings of the spiral wraps of the fixed scroll and the rotating scroll or the technique of using stepped scrolls in which the spiral wraps are high at the outer peripheral side and low at the inner peripheral side is used. In addition, as disclosed in PTLs 1 and 2, the technique of decreasing the minimum volume of the compression chamber as much as possible by decreasing the diameter of the discharge port, by forming the discharge port in an oval shape, or by forming the discharge port in a polygonal shape is sometimes employed.

CITATION LIST

Patent Literature

{PTL 1} Publication of Japanese Patent No. 3629836

{PTL 2} Japanese Unexamined Patent Application, Publication No. 2002-242863

SUMMARY OF INVENTION

Technical Problem

By decreasing the diameter of the discharge port or by forming the discharge port in an oval shape or a polygonal shape, as described above, the onset of backflow of the compressed fluid that is generated when the outer wall of the spiral wrap of the rotating scroll crosses the discharge port, causing the next compression chamber on the outer side of the central compression chamber to communicate with the discharge port, is delayed relative to the backflow of the compressed fluid that occurs when the engagement between the fixed scroll and the rotating scroll is released, causing the central compression chamber and the next compression chamber on the outer side thereof to communicate with each other, and thus the timings can be shifted. This can reduce pressure fluctuations in the compressed fluid remaining in the central compression chamber including the discharge port, thus reducing noise due to the pressure waves thereof. However, these techniques have the following problems.

The technique of decreasing the diameter of the discharge port has a problem in that the cross-sectional area of the flow channel of the discharge port is decreased, which increases the pressure loss, thus causing an increase in input power. The technique of forming the discharge port in an oval shape inevitably involves more time for machining the discharge port by end-milling although a sufficient cross-sectional area of the channel can be provided, thus decreasing the production efficiency, and hence it is very difficult to put it into practical use. Furthermore, the technique of forming the discharge port in a polygonal shape is difficult to be put into practical use because milling thereof is practically impossible.

The present invention is made in consideration of such circumstances, and an object thereof is to provide a scroll compressor in which the shape of a discharge port thereof is changed so that noise due to pressure fluctuations in compressed fluid remaining in a central compression chamber including the discharge port can be reduced and machining thereof can be simplified, and a method for machining the discharge port.

Solution to Problem

To solve the problems described above, a scroll compressor and a method for machining a discharge port thereof according to the present invention adopt the following solutions.

A scroll compressor according to a first aspect of the present invention is a scroll compressor in which a paired fixed scroll and rotating scroll each having a spiral wrap provided upright on an end plate are engaged to form a compression chamber and in which a discharge port that discharges fluid compressed in the compression chamber is provided at the central portion of the fixed scroll, wherein the discharge port has a deformed elongated hole shape having circular holes at both ends, and the circular holes at both ends are connected by two surfaces the width between which is smaller than the hole diameters of the circular holes.

According to the first aspect of the present invention, since the discharge port has a deformed elongated hole shape in which circular holes are provided at both ends, and the circular holes at both ends are connected by two surfaces the width between which is smaller than the hole diameters of the circular holes, pressure fluctuations in the compressed fluid remaining in the central compression chamber including the discharge port can be reduced by delaying the onset of the backflow of the compressed fluid that is generated when the outer wall of the spiral wrap of the rotating scroll crosses the discharge port, causing the next compression chamber on the outer side of the central compression chamber to communicate with the discharge port, relative to the backflow of the compressed fluid that is generated when the engagement of the fixed scroll and the rotating scroll is released, causing the central compression chamber and the next compression chamber on the outer side thereof to communicate with each other, thereby shifting the timings, while ensuring a sufficient cross-sectional area of the flow channel of the discharge port. Accordingly, this can reduce noise due to pressure waves generated due to the backflow of the compressed fluid. Since the deformed-elongated-hole-shaped discharge port can easily be machined by drilling the circular holes at both ends and then inserting an end mill having a diameter corresponding to the width between the two surfaces which is smaller than the hole diameter of one of the circular holes into said one circular hole and machining the two surfaces by end-milling, a bottleneck in machining can be eliminated, and thus, its practical value can be improved.

In the scroll compressor of the first aspect of the present invention, preferably, the circular holes at both ends have the same diameter, and the width between the two surfaces therebetween is set to be smaller than the hole diameters of the circular holes at both ends.

With this configuration, since the circular holes at both ends have the same diameter, and the width between the two surfaces therebetween is set smaller than the hole diameters of the circular holes at both ends, the circular holes at both ends can be machined with a drill having the same diameter, and thereafter, an end mill is inserted into one of the circular holes, and the two surfaces can be machined by end-milling. Accordingly, this can rationalize and simplify machining of the deformed-elongated-hole-shaped discharge port, which reduces the machining time, thus eliminating the bottleneck in machining.

Furthermore, in the scroll compressor of the first aspect of the present invention, preferably, the discharge port is provided closer to the spiral wrap by a distance corresponding to a constriction of the two surfaces the width between which is set to be smaller than the hole diameters of the circular holes at both ends.

With this configuration, since the discharge port is provided closer to the spiral wrap by a distance corresponding to the constriction of the two surfaces the width between which is set to be smaller than the hole diameters of the circular holes at both ends, the timing at which the outer wall of the spiral wrap of the rotating scroll crosses the discharge port, causing the next compression chamber on the outer side of the central compression chamber to communicate with the discharge port, can be further delayed as compared with the oval discharge port having the same flow channel cross-sectional area. Accordingly, this can reduce noise due to the backflow of the compressed fluid.

A scroll compressor according to a second aspect of the present invention is a scroll compressor in which a paired fixed scroll and rotating scroll each having a spiral wrap provided upright on an end plate are engaged to form a compression chamber and in which a discharge port that discharges fluid compressed in the compression chamber is provided at the central portion of the fixed scroll, wherein the discharge port has a deformed elongated hole shape in which a plurality of circular holes are continuously provided so as to partly overlap.

According to the second aspect of the present invention, since the discharge port has a deformed elongated hole shape in which a plurality of circular holes are continuously provided so as to partly overlap, the pressure fluctuations in compressed fluid remaining in the central compression chamber including the discharge port can be reduced by delaying the onset of the backflow of the compressed fluid that is generated when the outer wall of the spiral wrap of the rotating scroll crosses the discharge port, causing the next compression chamber on the outer side of the central compression chamber to communicate with the discharge port, relative to the backflow of the compressed fluid that is generated when the engagement of the fixed scroll and the rotating scroll is released, causing the central compression chamber and the next compression chamber on the outer side thereof to communicate with each other, thereby shifting the timings, while ensuring a sufficient cross-sectional area of the flow channel of the discharge port. Accordingly, this can reduce noise due to pressure waves generated due to the backflow of the compressed fluid. Furthermore, since the deformed-elongated-hole-shaped discharge port can easily be machined by continuously forming the plurality of circular holes by drilling so as to partly overlap, the bottleneck in machining can be eliminated, and the practical value can be improved.

A scroll compressor according to a third aspect of the present invention is a scroll compressor in which a paired fixed scroll and rotating scroll each having a spiral wrap provided upright on an end plate are engaged to form a compression chamber and in which a discharge port that discharges fluid compressed in the compression chamber is provided at the central portion of the fixed scroll, wherein the discharge port has a deformed elongated hole shape in which a circular hole having a large diameter and an ellipse having a hole diameter smaller than that of the circular hole are connected.

According to the third aspect of the present invention, since the discharge port has a deformed elongated hole shape in which a circular hole having a large diameter and an ellipse having a hole diameter smaller than that of the circular hole are connected, pressure fluctuations in compressed fluid remaining in the central compression chamber including the discharge port can be reduced by delaying the onset of the backflow of the compressed fluid that is generated when the outer wall of the spiral wrap of the rotating scroll crosses the discharge port, causing the next compression chamber on the outer side of the central compression chamber to communicate with the discharge port, relative to the backflow of the compressed fluid that is generated when the engagement of the fixed scroll and the rotating scroll is released, causing the central compression chamber and the next compression chamber on the outer side thereof to communicate with each other, thus shifting the timings, while ensuring a sufficient cross-sectional area of the flow channel of the discharge port. Accordingly, this can reduce noise due to pressure waves generated due to the backflow of the compressed fluid. Furthermore, since the deformed-elongated-hole-shaped discharge port can easily be machined by drilling the circular hole having the large diameter, inserting an end mill having a diameter corresponding to the ellipse having a diameter smaller than the hole diameter into the circular hole, and machining the ellipse connecting to the circular hole by end-milling, the bottleneck in machining can be eliminated, and the practical value can be improved.

In the scroll compressor of the first to third aspects of the present invention, preferably, the discharge port is provided at a position where the outer wall of the spiral wrap of the rotating scroll crosses the discharge port at a point corresponding to a wrap winding start angle of the spiral wraps of the fixed scroll and the rotating scroll, causing the discharge port to communicate with the next compression chamber on the outer side of the central compression chamber, at a timing delayed from the timing at which the spiral wrap of one scroll is separated from the inner wall of the spiral wrap of the other scroll, causing the central compression chamber to communicate with the next compression chamber on the outer side thereof.

With this configuration, since the discharge port is provided at a position where the outer wall of the spiral wrap of the rotating scroll crosses the discharge port at a point corresponding to a wrap winding start angle of the spiral wraps of the fixed scroll and the rotating scroll, causing the discharge port to communicate with the next compression chamber on the outer side of the central compression chamber, at a timing delayed from the timing at which the spiral wrap of one scroll is separated from the inner wall of the spiral wrap of the other scroll, causing the central compression chamber to communicate with the next compression chamber on the outer side thereof, the next compression chamber on the outer side of the central compression chamber can be made to communicate with the discharge port at a timing delayed from the timing at which the mutual engagement of the fixed scroll and the rotating scroll is released in the compression process, thus causing the central compression chamber and the next compression chamber on the outer side thereof to communicate with each other. Accordingly, this can reliably reduce pressure fluctuations in compressed fluid remaining in the central compression chamber including the discharge port, thus reducing noise due to the backflow of the compressed fluid.

A method for machining a discharge port of a scroll compressor according to a fourth aspect of the present invention is a method for machining the discharge port of the scroll compressor according to the first to third aspects of the present invention, wherein the deformed-elongated-hole-shaped discharge port is machined by drilling the circular holes at both ends, inserting an end mill having a diameter smaller than the hole diameter of one of the circular holes and corresponding to the width between the two surfaces into said one circular hole, and moving the end mill toward the other circular hole to machine the two surface by end-milling.

According to the fourth aspect of the present invention, the deformed-elongated-hole-shaped discharge port having circular holes at both ends, in which the circular holes at both ends are connected by the two surfaces the width between which is smaller than the hole diameters of the circular holes, is machined in such a manner that, after the circular holes at both ends are machined by drilling, and an end mill having a diameter smaller than the hole diameter of one of the circular holes and corresponding to the width between the two surfaces is inserted into said one circular hole, and the end mill is moved toward the other circular hole to machine the two surfaces by end-milling; therefore, the deformed-elongated-hole-shaped discharge port can be formed simply and in a short time at the central portion of the fixed scroll by the combination of drilling and end-milling. Thus, providing the deformed-elongated-hole-shaped discharge port, which is closely analogous to an oval shape that has been difficult to machine, in the fixed scroll can reduce noise.

In the method for machining the discharge port of the scroll compressor according to the fourth aspect of the present invention, preferably, burrs between the two surfaces and the circular holes are removed by machining the two surfaces by end-milling and thereafter moving the end mill along the inner circumference of the other circular hole.

With this configuration, since burrs between the two surfaces and the circular holes are removed by machining the two surfaces with the end mill and thereafter moving the end mill along the inner circumference of the other circular hole, the burrs between the two surfaces and the circular holes can be removed at the same time by using the end mill continuously in a series of continuous operations following the movement of the end mill during the machining of the two surfaces. Accordingly, this can simplify the deburring and improve the production efficiency of the fixed scroll.

In the method for machining the discharge port of the scroll compressor according to the fourth aspect of the present invention, preferably, the circular holes at both ends are chamfered by inserting a chamfering tool from one end face of the discharge port into the circular holes at both ends by a predetermined amount, and the two surfaces are chamfered with the insertion depth of the chamfering tool set to be smaller than that during chamfering of the circular holes at both ends.

With this configuration, the circular holes at both ends are chamfered by inserting the chamfering tool into the circular holes at both ends from the end face of the discharge port by a predetermined amount, and the two surfaces are chamfered with the insertion depth of the chamfering tool set to be smaller than that during chamfering of the circular holes. Therefore, the circular holes at both ends and the two surfaces around the edge of the deformed-elongated-hole-shaped discharge port, in which the circular holes at both ends are connected by the two surfaces the width between which is smaller than the hole diameters of the circular holes at both ends, can individually be provided with proper chamfers by adjusting the insertion depth of the chamfering tool. Accordingly, the chamfering of the edge of the discharge port can also be simplified, and the production efficiency of the fixed scroll can be improved. It is desirable that the chamfer along the two surfaces be as small as possible because increasing the chamfer of the two surfaces will lose the effect achieved by the constriction of the two surfaces.

In the method for machining the discharge port of the scroll compressor according to the fourth aspect of the present invention, preferably, after one of the circular holes at both ends is chamfered with the chamfering tool, the two surfaces are chamfered with the insertion depth of the chamfering tool changed, and thereafter, the other circular hole is chamfered with the insertion depth of the chamfering tool changed.

With this configuration, after one of the circular holes at both ends is chamfered using the chamfering tool, the two surfaces are chamfered with the insertion depth of the chamfering tool changed, and thereafter, the other circular hole is chamfered with the insertion depth of the chamfering tool changed; therefore, a series of chamfering operations can be performed in one process by moving the chamfering tool along the lengthwise direction of the deformed-elongated-hole-shaped discharge port and by changing the insertion depth between the positions of the circular holes at both ends. Thus, this can further simplify the chamfering of the edge of the discharge port, thus improving the production efficiency of the fixed scroll.

Advantageous Effects of Invention

According to the scroll compressor of the present invention, since pressure fluctuations in compressed fluid remaining in the central compression chamber including the discharge port can be reduced by delaying the onset of the backflow of the compressed fluid that is generated when the outer wall of the spiral wrap of the rotating scroll crosses the discharge port, causing the next compression chamber on the outer side of the central compression chamber to communicate with the discharge port, relative to the backflow of the compressed fluid that is generated when the engagement of the fixed scroll and the rotating scroll is released, causing the central compression chamber and the next compression chamber on the outer side thereof to communicate with each other, thus shifting the timings, while ensuring a sufficient cross-sectional area of the flow channel of the discharge port, noise due to pressure waves generated due to the backflow of the compressed fluid can be reduced. Since the deformed-elongated-hole-shaped discharge port can easily be machined by drilling the circular holes at both ends and then inserting an end mill having a diameter corresponding to the width between the two surfaces which is smaller than the hole diameter of one of the circular holes into one of the circular holes and machining the two surfaces by end-milling, a bottleneck in machining can be eliminated, and thus, its practical value can be improved.

According to the scroll compressor of the present invention, since the deformed-elongated-hole-shaped discharge port in which a plurality of circular holes are continuously provided so as to partly overlap can easily be machined by continuously forming the plurality of circular holes by drilling so as to partly overlap, the bottleneck in machining can be eliminated, and the practical value can be improved.

Furthermore, according to the scroll compressor of the present invention, since the deformed-elongated-hole-shaped discharge port in which a circular hole having a large diameter and an ellipse having a hole diameter smaller than that of the circular hole are connected can easily be machined by drilling the circular hole having the large diameter, inserting an end mill having a diameter corresponding to the ellipse having a diameter smaller than the hole diameter into the circular hole, and machining the ellipse connecting to circular hole by end-milling, the bottleneck in machining can be eliminated, and the practical value can be improved.

According to the method for machining the discharge port of the scroll compressor of the present invention, since the deformed-elongated-hole-shaped discharge port can be formed simply and in a short time at the central portion of the fixed scroll by the combination of drilling and end-milling, providing the deformed-elongated-hole-shaped discharge port, which is closely analogous to an oval shape that has been difficult to machine, in the fixed scroll can reduce noise.

DESCRIPTION OF EMBODIMENTS

Embodiments according to the present invention will be described hereinbelow with reference to the drawings.

First Embodiment

A first embodiment of the present invention will be described hereinbelow using FIGS. 1 to 4.

Figure 1:
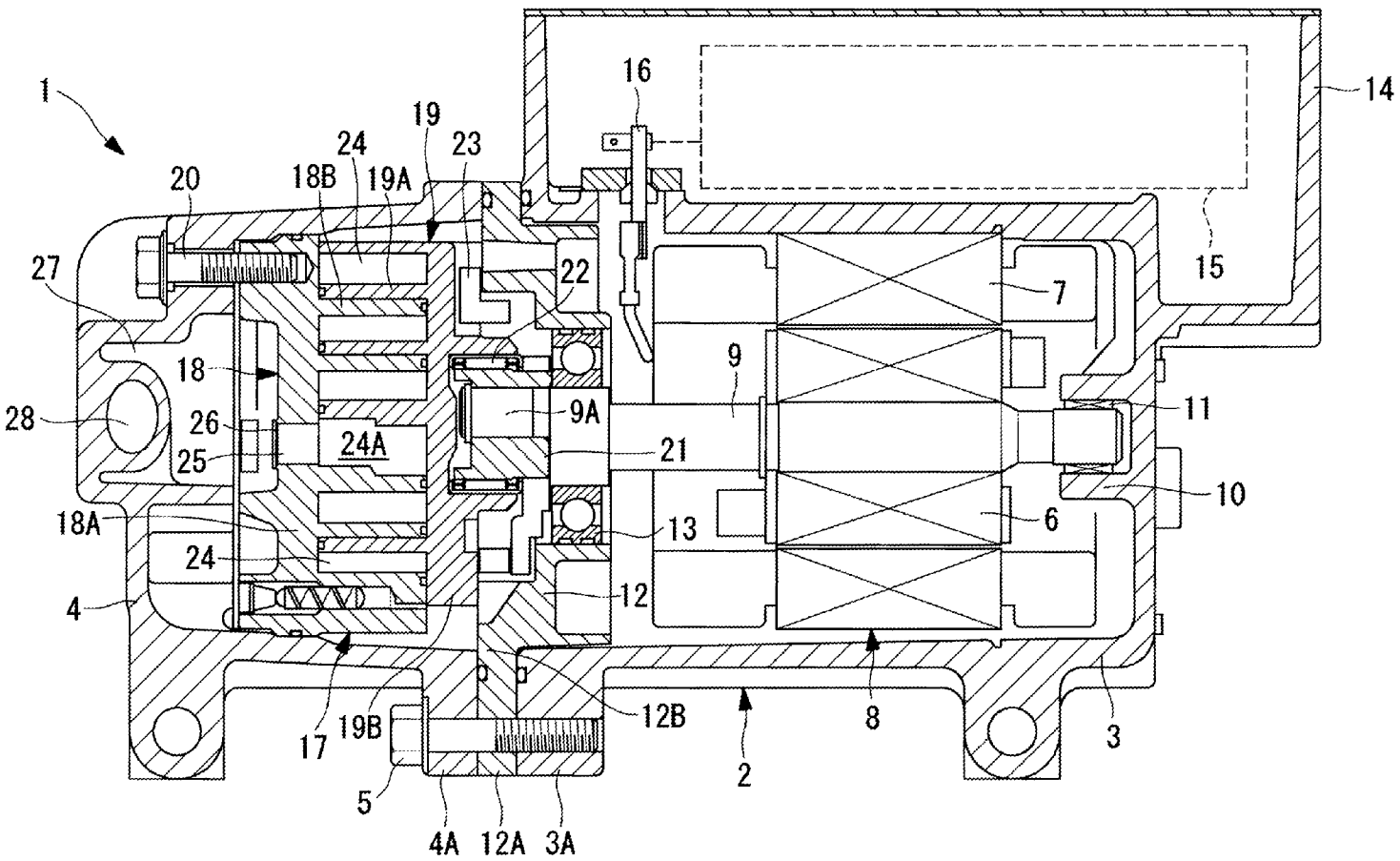
FIG. 1 is a longitudinal cross-sectional view of a scroll compressor according to a first embodiment of the present invention.
Figure 2:
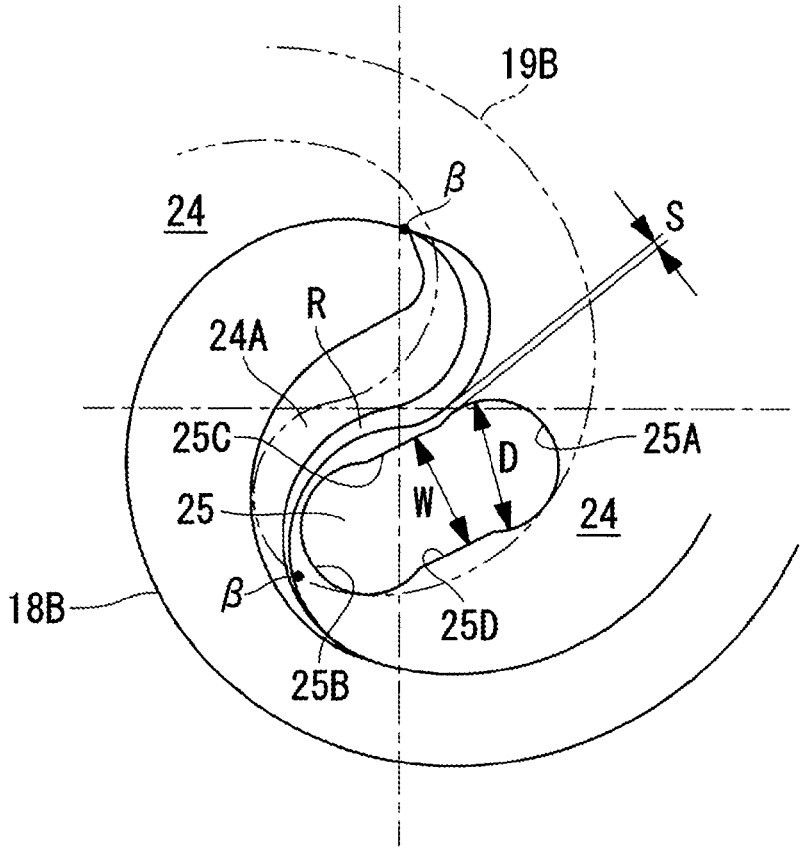
FIG. 2 is a diagram showing the engagement of scrolls around a discharge port in the scroll compressor shown in FIG. 1.

FIG. 1 shows a longitudinal cross-sectional view of a scroll compressor according to the first embodiment of the present invention, and FIG. 2 is a diagram showing the engagement of scrolls around its discharge port.

A scroll compressor 1 is equipped with a cylindrical housing 2 that constitutes the outer shell thereof. The housing 2 is composed of a motor housing 3 and a compressor housing 4, which are made of die-cast aluminum and are each formed in a bowl shape. The motor housing 3 and the compressor housing 4 are configured such that flanges 3A and 4A provided at a plurality of locations around the openings are joined together with bolts 5, with flanges 12A of a bearing member 12, described later, sandwiched therebetween.

The motor housing 3 accommodates a motor 8 constituted by a rotor 6 and a stator 7, and a crankshaft 9 is integrally joined with the rotor 6. The rear end of the crankshaft 9 is rotatably supported by a bearing portion 10 provided on the rear end wall of the motor housing 3 via a bearing 11, and the front end is rotatably supported by the bearing member 12 disposed between the motor housing 3 and the compressor housing 4 via a bearing 13. The front end of the crankshaft 9 is integrally provided with a crankpin 9A that is eccentric relative to the axial center by a predetermined distance.

An inverter accommodating section 14 is integrally formed on the outer periphery of the motor housing 3 and accommodates an inverter 15 that drives the motor 8. The inverter 15 converts direct-current power supplied from an external power source to a three-phase alternating-current power having a command frequency and applies it to the motor 8 accommodated in the motor housing 3 via a glass-sealed terminal 16. The inverter 15 may be a known inverter, and a detailed description thereof will be omitted.

The compressor housing 4 accommodates a scroll compression mechanism 17 constituted by a fixed scroll 18 and a rotating scroll 19. The fixed scroll 18 is configured such that a spiral wrap 18B is provided upright on an end plate 18A and is securely fixed in the compressor housing 4 with a bolt 20. The rotating scroll 19 is configured such that a spiral wrap 19B is provided upright on an end plate 19A and is disposed so as to be orbitally driven around the fixed scroll 18 because a boss 19C provided at the back of the end plate 19A is coupled with the crankpin 9A of the crankshaft 9 via a drive bush 21 and a rotating bearing 22.

The rotating scroll 19 is disposed such that the back surface of the end plate 19A is supported by a thrust bearing portion 12B of the bearing member 12 and such that the rotation thereof is prevented by a rotation prevention mechanism 23, such as an Oldham's ring, disposed between the thrust bearing portion 12B and the back surface of the end plate 19A. As is well known, the fixed scroll 18 and the rotating scroll 19 are configured such that the spiral wraps 18B and 19B are opposed and engaged 180° out of phases with each other so that a pair of compression chambers 24 is formed.

The pair of compression chambers 24 is configured to perform a compressing operation by continuously repeating the operation wherein, the compression chambers 24 formed at the outermost peripheral positions of the fixed and rotating scrolls 18 and 19 when an intake is shut off are moved to the center while being decreased in volume as the rotating scroll 19 is orbitally driven and wherein the engagement of the fixed and rotating scrolls 18 and 19 is released at the center, so that they join to form one central compression chamber 24A. The fluid compressed in the compression chambers 24 is discharged to a discharge chamber 27 through a discharge port 25 provided at the central part of the fixed scroll 18 via a discharge valve 26 and is discharged outwards through a discharge opening 28 provided in the compressor housing 4.

In this embodiment, as shown in FIG. 2, the discharge port 25 has a deformed elongated hole shape having circular holes 25A and 25B at both ends, and the circular holes 25A and 25B at both ends are connected by two surfaces 25C and 25D, the width W therebetween being smaller than the hole diameters D of the circular holes 25A and 25B. The diameters D of the circular holes 25A and 25B at both ends of the discharge port 25 are set at the same diameter, for example, 5 mm, while the width W between the two surfaces 25C and 25D is set to be smaller than that (D>W), for example, at 4.5 mm.

The discharge port 25 is provided at a position where the outer wall of the spiral wrap 19B of the rotating scroll 19 crosses the discharge port 25 at a point corresponding to a wrap winding start angle of the spiral wraps 18B and 19B of the fixed scroll 18 and the rotating scroll 19, that is, a point β corresponding to an involute angle, which is an angle to one involute point on an involute curve with the base point on the base circle of the involute curve defined as the starting position, causing the discharge port 25 to communicate with the next compression chamber 24 on the outer side of the central compression chamber 24A, at a timing delayed from the timing at which the spiral wrap 18B or 19B of one scroll is separated from the inner wall of the spiral wrap 18B or 19B of the other scroll (comes into contact at the involute angle β), causing the central compression chamber 24A to communicate with the next compression chamber 24 on the outer side thereof. FIG. 2 shows a state directly before the spiral wrap 19B of the rotating scroll 19 crosses the discharge port 25 after the engagement at the point β is released, causing the discharge port 25 to communicate with the next compression chamber 24 on the outer side of the central compression chamber 24A.

Figure 3:
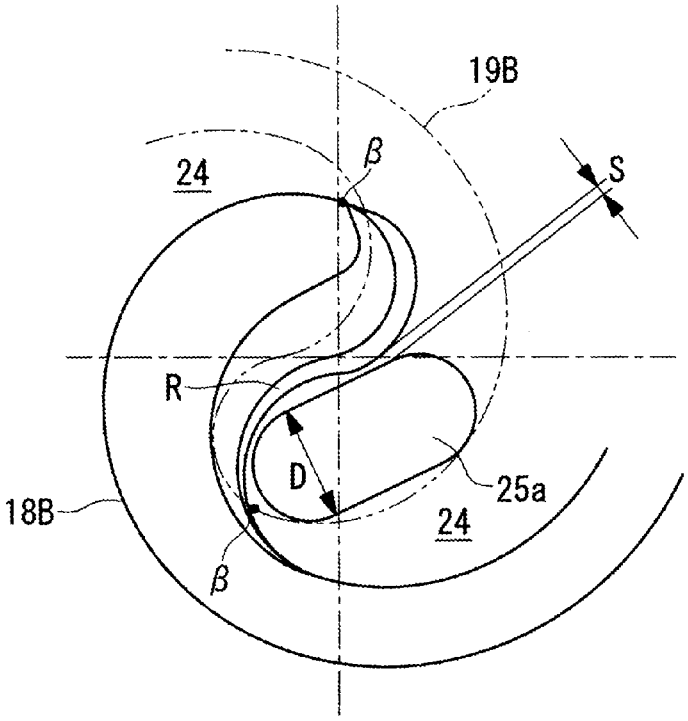
FIG. 3 is a diagram showing the engagement of scrolls around a discharge port of a comparative example related to the discharge port shown in FIG. 2.

The discharge port 25 is shaped such that the width W between the two surfaces 25C and 25D is smaller than the hole diameters D of the circular holes 25A and 25B at both ends, and thus, the two surfaces are constricted and are provided at positions closer to the spiral wrap 18B by a distance corresponding to the constriction relative to an oval discharge port 25*a* of a comparative example, shown in FIG. 3. That is, in the case where the discharge port is provided a predetermined distance S, for example, 0.3 mm, away from a very small R provided at the base of the spiral wrap 18B to prevent the discharge port 25 from coming into contact with the very small R, the oval discharge port 25*a* has a limitation to the distance S from the very small R due to the straight lines connecting the arcs at both ends; however, with the discharge port 25 having a constriction, the distance S is determined by the constriction, and hence the discharge port 25 can be disposed closer to the spiral wrap 18B by a corresponding distance.

Furthermore, the deformed-elongated-hole-shaped discharge port 25 can easily be machined in such a manner that, after the circular holes 25A and 25B at both ends are bored by drilling, an end mill having a diameter smaller than the hole diameter D of one of the circular holes 25A and 25B and corresponding to the width W between the two surfaces 25C and 25D is inserted into said one circular hole 25A or 25B, and the end mill is moved toward the other circular hole 25A or 25B to machine the two surfaces 25C and 25D by end-milling.

When the two surfaces 25C and 25D are to be machined with the end mill, by moving the end mill along the inner circumference of the other circular hole 25A or 25B with the larger diameter D after machining the two surfaces 25C and 25D with the end mill, burrs between the two surfaces 25C and 25D and the circular hole 25A or 25B are removed using the end mill continuously in a series of continuous operations following the movement of the end mill when the two surfaces 25C and 25D are machined, and thus the deburring is simplified.

Figure 4:
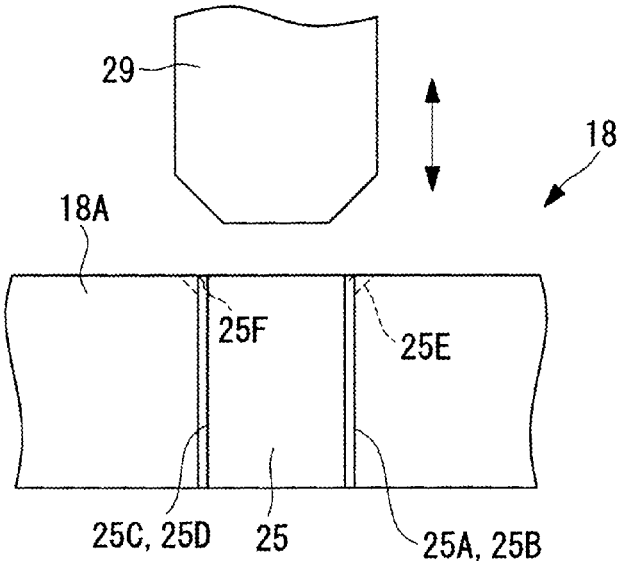
FIG. 4 is an explanatory diagram of a method for chamfering the edge of the discharge port of the scroll compressor shown in FIG. 1.

In addition, it is necessary to chamfer the edge of the discharge port 25. The chamfering is performed using a chamfering tool 29, as shown in FIG. 4. Merely by changing the insertion depth of the chamfering tool 29 in the direction of the arrows between the case where the edges of the circular holes 25A and 25B at both ends are chamfered and the case where the edges of the two surfaces 25C and 25D are chamfered, desired chamfering can easily be performed. That is, when chamfers 25E are to be provided around the edges of the circular holes 25A and 25B, a relatively large chamfer 25E can be provided by increasing the insertion depth of the chamfering tool 29, and when chamfers 25F are to be provided along the peripheries of the two surfaces 25C and 25D, a relatively small chamfer 25F can be provided by decreasing the insertion depth of the chamfering tool 29.

The chamfering is performed as follows: first, the chamfer 25E is formed around one of the circular holes 25A and 25B at both ends by inserting the chamfering tool 29 in the direction of the arrow by a predetermined amount, with it centered at one of the circular holes 25A and 25B, then, the chamfer 25F is formed along the edges of the two surfaces 25C and 25D while moving the chamfering tool 29 in the direction of the two surfaces 25C and 25D with the insertion depth of the chamfering tool 29 reduced by a predetermined distance, and thereafter, the chamfer 25E can be formed around the other one of the circular holes 25A and 25B at both ends by inserting the chamfering tool 29 again by a predetermined amount, with it centered on the other circular hole.

Thus, the desired chamfers 25E and 25F can be formed around the circular holes 25A and 25B at both ends and along the peripheries of the two surfaces 25C and 25D, respectively. It is desirable that the chamfer 25F along the two surfaces 25C and 25D be as small as possible because increasing the chamfer 25F thereof would lose the effect of the constriction of the two surfaces 25C and 25D.

Thus, this embodiment provides the following advantageous effects.

In the scroll compressor 1, fluid (refrigerant gas) taken into the motor housing 3 flows in the housing 2 and is taken into the pair of compression chambers 24 of the scroll compression mechanism 17, where it is compressed when the compression chambers 24 are moved toward the center while being reduced in volume as the rotating scroll 19 is orbitally driven. The pair of compression chambers 24 is joined with the central compression chamber 24A when the engagement of the fixed scroll 18 and the rotating scroll 19 is released when the engaging point of the fixed scroll 18 and the rotating scroll 19 passes through the point β corresponding to the wrap winding start angle of the spiral wraps 18B and 19B.

When the compressing operation further advances from this state, and the compressed fluid reaches a discharge pressure to push open the discharge valve 26, the fluid is discharged from the central compression chamber 24A to the discharge chamber 27 through the discharge port 25. During this operation, when the engaging point of the fixed scroll 18 and the rotating scroll 19 passes through the point β, and the compression chambers 24 are joined with the central compression chamber 24A, high-pressure fluid remaining in the central compression chamber 24A and the discharge port 25 generates a first backflow toward the pair of compression chambers 24. On the other hand, when the engagement of the fixed scroll 18 and the rotating scroll 19 is released at the point β, and the rotation of the rotating scroll 19 advances further, the state shown in FIG. 2 occurs.

The state in FIG. 2 shows a state directly before the outer wall of the spiral wrap 19B of the rotating scroll 19 crosses the discharge port 25, and when the rotation of the rotating scroll 19 advances further, causing the compression chambers 24 and the discharge port 25 to communicate with each other, and a second backflow is generated from the discharge port 25 and the central compression chamber 24A toward the compression chambers 24. However, the second backflow and the first backflow, described above, differ in timing; after the first backflow is generated, the second backflow is generated after a delay corresponding to a predetermined rotation angle.

That is, since the deformed-elongated-hole-shaped discharge port 25 in which the circular holes 25A and 25B are provided at both ends and in which the circular holes 25A and 25B at both ends are connected by the two surfaces 25C and 25D whose width W is smaller than the hole diameters D of the circular holes is provided closer to the inner end of the spiral wrap 18B of the fixed scroll 18 and closer to the spiral wrap 18B, the onset of the second backflow of the compressed fluid, which is generated when the outer wall of the spiral wrap 19B of the rotating scroll 19 crosses the discharge port 25, causing the next compression chamber 24 on the outer side of the central compression chamber 24A to communicate with the discharge port 25, is delayed relative to the first backflow of the compressed fluid, which is generated when the engagement of the fixed scroll 18 and the rotating scroll 19 is released, causing the central compression chamber 24A and the next compression chamber 24 on the outer side thereof to communicate with each other, thereby shifting the timings, while ensuring a sufficient cross-sectional area of the flow channel of the discharge port 25.

This can reduce pressure fluctuations in the compressed fluid remaining in the central compression chamber 24A including the discharge port 25, thus reducing noise due to pressure waves generated due to the backflow of the compressed fluid. Since the deformed-elongated-hole-shaped discharge port 25 can easily be machined by drilling the circular holes 25A and 25B at both ends and then inserting an end mill having a diameter corresponding to the width W between the two surfaces 25C and 25D smaller than the hole diameter D of one of the circular holes 25A and 25B into one of the circular holes 25A and 25B and machining the two surfaces 25C and 25D by end-milling, a bottleneck in machining can be eliminated.

In the case of the oval discharge port 25*a* shown in FIG. 3 as a comparative example, even if the circular holes at both ends can be machined by drilling, in practice, it is difficult to insert an end mill having the same diameter into the holes. Thus, it is necessary to machine the holes so as to dig in from the surface side by a predetermined distance at a time, which increases the machining time, and hence this is not used in practice. However, this embodiment can eliminate such a bottleneck in machining, thus improving its practical value.

In contrast to this oval discharge port 25*a*, in the case of the deformed-elongated-hole-shaped discharge port 25 in which the width W between the two surfaces 25C and 25D is smaller than the hole diameters D of the circular holes 25A and 25B, the two surfaces 25C and 25D are constricted, and thus, even when the discharge port 25 is to be provided the distance S away from the base of the spiral wrap 18B, the discharge port 25 can be disposed closer to the spiral wrap 18B. This allows noise due to the backflow of the compressed fluid to be reduced by a corresponding amount as compared with the comparative example shown in FIG. 3.

Since the circular holes 25A and 25B at both ends have the same diameter, and since the width W between the two surfaces 25C and 25D therebetween is set smaller than the hole diameters D of the circular holes 25A and 25B at both ends, the circular holes 25A and 25B at both ends can be machined with a drill having the same diameter, and thereafter, an end mill is inserted into one of the circular holes 25A and 25B, and the two surfaces 25C and 25D can be machined by end-milling. Accordingly, this can rationalize and simplify machining of the deformed-elongated-hole-shaped discharge port 25, which reduces the machining time, thus eliminating the bottleneck in machining.

Furthermore, in this embodiment, the deformed-elongated-hole-shaped discharge port 25 is machined in such a manner that, after the circular holes 25A and 25B at both ends are machined by drilling, and an end mill having a diameter smaller than the hole diameter D of one of the circular holes 25A and 25B and corresponding to the width W between the two surfaces 25C and 25D is inserted into this one circular hole 25A or 25B, and the end mill is moved toward the other circular hole to machine the two surfaces 25C and 25D by end-milling. Therefore, the deformed-elongated-hole-shaped discharge port 25 can be formed simply and in a short time at the central portion of the fixed scroll 18 by the combination of drilling and end-milling. Thus, the deformed-elongated-hole-shaped discharge port 25, which is closely analogous to an oval shape and has been difficult to machine, can be provided in the fixed scroll 18, thereby reducing noise.

When the discharge port 25 is machined by the foregoing method, burrs between the two surfaces 25C and 25D and the circular holes 25A and 25B are removed by machining the two surfaces 25C and 25D with the end mill and thereafter moving the end mill along the inner circumference of the other circular hole 25A or 25B. Thus, burrs between the two surfaces 25C and 25D and the circular holes 25A and 25B can be removed at the same time using the end mill continuously in a series of continuous operations following the movement of the end mill during the machining of the two surfaces 25C and 25D, and hence the deburring can be simplified, and the production efficiency of the fixed scroll 18 can be improved.

Furthermore, in this embodiment, when the edge of the discharge port 25 is to be chamfered, the edges of the circular holes 25A and 25B at both ends are chamfered by inserting the chamfering tool 29 into the circular holes 25A and 25B at both ends from the end face of the discharge port 25 by a predetermined amount, and the two surfaces 25C and 25D are chamfered with the insertion depth of the chamfering tool 29 set to be smaller than that during chamfering of the circular holes 25A and 25B. Therefore, the edges of the circular holes 25A and 25B at both ends of the discharge port 25, which are connected by the two surfaces 25C and 25D whose width W is smaller than the hole diameters D of the circular holes 25A and 25B at both ends, and the edges of the two surfaces 25C and 25D can be provided with the proper chamfers 25E and 25F, respectively, by adjusting the insertion depth of the chamfering tool 29. Accordingly, chamfering of the edge of the discharge port 25 can also be simplified, and the production efficiency of the fixed scroll 18 can be improved.

In the chamfering, since, after one of the circular holes 25A and 25B at both ends is chamfered using the chamfering tool 29, the two surfaces 25C and 25D are chamfered with the insertion depth of the chamfering tool 29 changed, and thereafter, the other of the circular holes 25A and 25B is chamfered with the insertion depth of the chamfering tool 29 changed, a series of chamfering operations can be performed in a single process by moving the chamfering tool 29 along the lengthwise direction of the deformed-elongated-hole-shaped discharge port 25 and by changing the insertion depth between the positions of the circular holes 25A and 25B at both ends. Thus, this can further simplify the chamfers 25E and 25F around the edge of the discharge port 25, thus improving the production efficiency of the fixed scroll 18.

Second Embodiment

Next, a second embodiment of the present invention will be described using FIG. 5.

This embodiment differs from the foregoing first embodiment in the configuration of a discharge port 35. Since the other features are the same as those of the first embodiment, descriptions thereof will be omitted.

Figure 5:
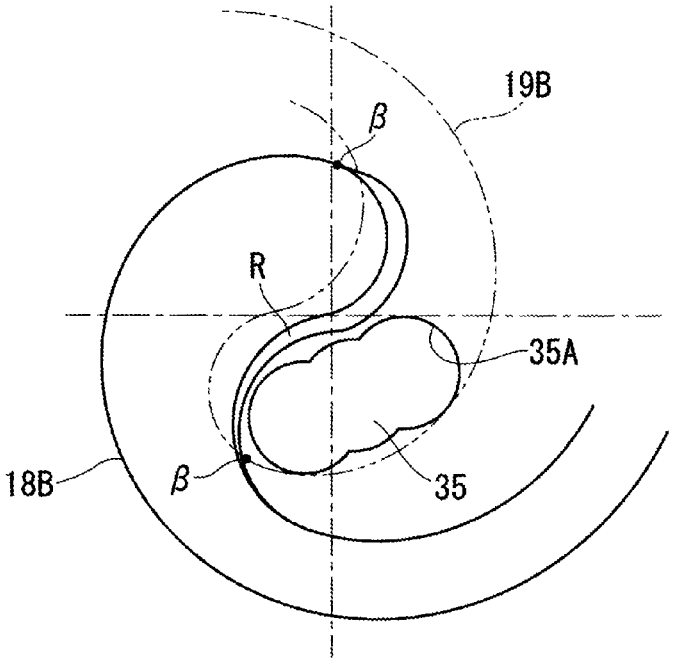
FIG. 5 is a diagram showing the engagement of scrolls around a discharge port in a scroll compressor according to a second embodiment of the present invention.

In this embodiment, the discharge port 35 is formed in a deformed elongated hole shape in which a plurality of circular holes 35A are continuously provided so as to partly overlap, as shown in FIG. 5.

As described above, also with the discharge port 35 having the configuration in which the plurality of circular holes 35A are continuously provided so as to partly overlap, the pressure fluctuations in compressed fluid remaining in the central compression chamber 24A including the discharge port 35 can be reduced by delaying the onset of the backflow of the compressed fluid that is generated when the outer wall of the spiral wrap 19B of the rotating scroll 19 crosses the discharge port 35, causing the next compression chamber 24 on the outer side of the central compression chamber 24A to communicate with the discharge port 35, relative to the backflow of the compressed fluid that is generated when the engagement of the fixed scroll 18 and the rotating scroll 19 is released, causing the central compression chamber 24A and the next compression chamber 24 on the outer side to communicate with each other, thereby shifting the timings, while ensuring a sufficient cross-sectional area of the flow channel of the discharge port 35.

Accordingly, this can reduce noise due to pressure waves generated due to the backflow of the compressed fluid, as in the first embodiment. Furthermore, since the deformed-elongated-hole-shaped discharge port 35 can easily be machined by continuously forming, by drilling, the plurality of circular holes 35A so as to partly overlap, the bottleneck in machining can be eliminated, and the practical value can be improved.

Third Embodiment

Next, a third embodiment of the present invention will be described using FIG. 6.

This embodiment differs from the foregoing first and second embodiments in the configuration of a discharge port 45. Since the other features are the same as those of the first and second embodiments, descriptions thereof will be omitted.

Figure 6:
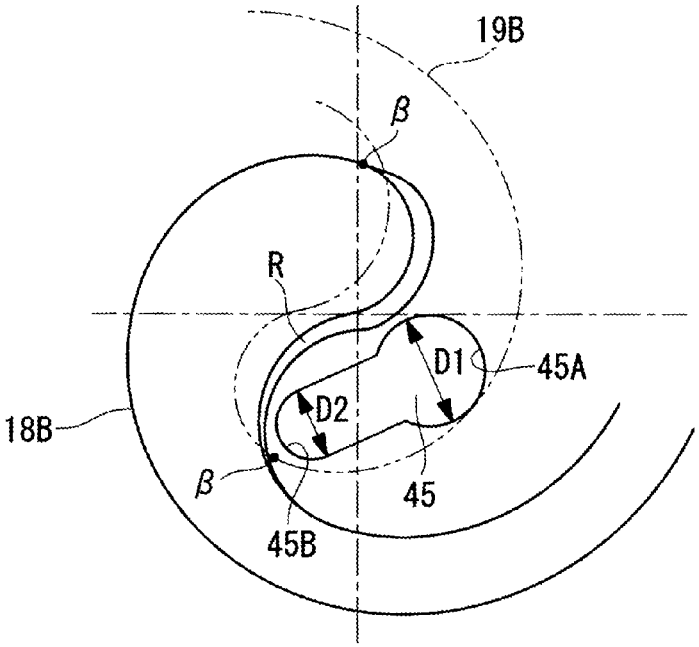
FIG. 6 is a diagram showing the engagement of scrolls around a discharge port in a scroll compressor according to a third embodiment of the present invention.

In this embodiment, the discharge port 45 is formed in a deformed elongated hole shape in which a circular hole 45A having a large diameter D1 and an ellipse 45B having a hole diameter D2 smaller than that of the circular hole 45A are connected, as shown in FIG. 6.

As described above, also with the deformed-elongated-hole-shaped discharge port 45 in which the circular hole 45A having the large diameter D1 and the ellipse 45B having the hole diameter D2 smaller than that of the circular hole 45A are connected, the pressure fluctuations in compressed fluid remaining in the central compression chamber 24A including the discharge port 45 can be reduced by delaying the onset of the backflow of the compressed fluid that is generated when the outer wall of the spiral wrap 19B of the rotating scroll 19 crosses the discharge port 45, causing the next compression chamber 24 on the outer side of the central compression chamber 24A to communicate with the discharge port 45, relative to the backflow of the compressed fluid that is generated when the engagement of the fixed scroll 18 and the rotating scroll 19 is released, causing the central compression chamber 24A and the next compression chamber 24 on the outer side thereof to communicate with each other, thus shifting the timings, while ensuring a sufficient cross-sectional area of the flow channel of the discharge port 45, as in the first and second embodiments.

Accordingly, this embodiment can also reduce noise due to pressure waves generated due to the backflow of the compressed fluid. Furthermore, since the deformed-elongated-hole-shaped discharge port 45 can easily be machined by drilling the circular hole 45A having the large diameter D1, inserting an end mill having a diameter corresponding to the ellipse 45B having a diameter smaller than the hole diameter D1 into the circular hole 45A, and machining the ellipse 45B connecting to circular hole 45A by end-milling, the bottleneck in machining can be eliminated, and the practical value can be improved.

The present invention is not limited to the invention according to the foregoing embodiments; various modifications can be made as appropriate without departing from the spirit thereof. For example, although the embodiments show the respective spiral wraps 18B and 19B of the fixed scroll 18 and the rotating scroll 19 whose wrap thicknesses are changed in two steps in the heightwise direction only at the inner peripheral end (see FIG. 1), the present invention is not limited thereto, and it is needless to say that the present invention can also be applied to a normal scroll compressor, a stepped scroll compressor whose wrap heights differ at the inner peripheral side and the outer peripheral side, and so on.

Although an example of application to the electric scroll compressor 1 that accommodates the motor 8 has been described in the foregoing embodiments, it is needless to say that the present invention can also be applied to an open-type scroll compressor that accommodates no driving source. Furthermore, in the foregoing embodiment, although the area of the discharge port 25 is reduced relative to the oval discharge port 25*a* of the comparative example shown in FIG. 3 by an area corresponding to the constriction, it has been confirmed that there is almost no difference in performance. Of course, the lengthwise dimension of the discharge port 25 may be increased by a distance corresponding to the area of the constriction to provide the same area.

REFERENCE SIGNS LIST

1 scroll compressor
18 fixed scroll
18A end plate
18B spiral wrap
19 rotating scroll
19A end plate
19B spiral wrap
24 compression chamber
24A central compression chamber
25, 35, 45 discharge port
25A, 25B circular holes at both ends
25C, 25D two surfaces
25E chamfer of circular holes at both ends
25F chamfer of two surfaces
29 chamfering tool
35A plurality of circular holes
45A circular hole
45B ellipse
D hole diameter of circular holes at both ends
W width between two surfaces
β point corresponding to wrap winding start angle

The invention claimed is:

1. A scroll compressor, comprising:

a paired fixed scroll and rotating scroll each having a spiral wrap provided upright on an end plate are engaged to form a compression chamber and in which a discharge port that discharges fluid compressed in the compression chamber is provided at the central portion of the fixed scroll, wherein the discharge port has a deformed elongated hole shape having circular holes at both ends, and the circular holes at both ends are connected by two surfaces the width between which is smaller than the hole diameters of the circular holes.

2. The scroll compressor according to claim 1, wherein the circular holes at both ends have the same diameter, and the width between the two surfaces therebetween is set to be smaller than the hole diameters of the circular holes at both ends.

3. The scroll compressor according to claim 1, wherein the discharge port is provided closer to the spiral wrap by a distance corresponding to a constriction of the two surfaces the width between which is set to be smaller than the hole diameters of the circular holes at both ends.

4. The scroll compressor according to claim 1, wherein the discharge port is provided at a position where the outer wall of the spiral wrap of the rotating scroll crosses the discharge port at a point corresponding to a wrap winding start angle of the spiral wraps of the fixed scroll and the rotating scroll, causing the discharge port to communicate with the next compression chamber on the outer side of the central compression chamber, at a timing delayed from the timing at which the spiral wrap of one scroll is separated from the inner wall of the spiral wrap of the other scroll, causing the central compression chamber to communicate with the next compression chamber on the outer side thereof.

5. A method for machining a discharge port of a scroll compressor provided at a central portion of a fixed scroll, comprising:

machining the circular holes at both ends by drilling;

inserting an end mill having a diameter smaller than a hole diameter of one of the circular holes and corresponding to a width between two surfaces into said one circular hole; and moving the end mill toward the other circular hole to machine the two surface by end-milling, wherein the discharge port is machined so as to be formed in a deformed elongated hole shape having circular holes at both ends, and the circular holes at both ends are connected by two surfaces a width between which is smaller than a hole diameters of the circular holes.

6. The method for machining the discharge port of the scroll compressor according to claim 5, wherein burrs between the two surfaces and the circular holes are removed by machining the two surfaces with the end mill and thereafter moving the end mill along the inner circumference of the other circular hole.

7. The method for machining the discharge port of the scroll compressor according to claim 5, wherein the circular holes at both ends are chamfered by inserting a chamfering tool from one end face of the discharge port into the circular holes at both ends by a predetermined amount, and the two surfaces are chamfered with the insertion depth of the chamfering tool set to be smaller than that during chamfering of the circular holes at both ends.

8. The method for machining the discharge port of the scroll compressor according to claim 7, wherein after one of the circular holes at both ends is chamfered with the chamfering tool, the two surfaces are chamfered with the insertion depth of the chamfering tool changed, and thereafter, the other circular hole is chamfered with the insertion depth of the chamfering tool changed.

* * * * *